US010059912B2

(12) United States Patent
Cooley et al.

(10) Patent No.: US 10,059,912 B2
(45) Date of Patent: Aug. 28, 2018

(54) MULTI-COMPARTMENT WATER-SOLUBLE CAPSULES

(71) Applicant: Conopco, Inc., Englewood Cliffs, NJ (US)

(72) Inventors: Stuart Stephen Cooley, Wirral (GB); Paul Naylor, Warrington (GB)

(73) Assignee: CONOPCO, INC., Englewood Cliffs, NJ (US)

( * ) Notice: Subject to any disclaimer, the term of this patent is extended or adjusted under 35 U.S.C. 154(b) by 113 days.

(21) Appl. No.: 14/896,696

(22) PCT Filed: Jun. 6, 2014

(86) PCT No.: PCT/EP2014/061858
§ 371 (c)(1),
(2) Date: Dec. 8, 2015

(87) PCT Pub. No.: WO2014/202412
PCT Pub. Date: Dec. 24, 2014

(65) Prior Publication Data

US 2016/0130538 A1 May 12, 2016

(30) Foreign Application Priority Data

Jun. 19, 2013 (EP) ..... 13172900

(51) Int. Cl.
*C11D 17/04* (2006.01)
*C11D 11/00* (2006.01)
(Continued)

(52) U.S. Cl.
CPC ..... *C11D 17/045* (2013.01); *B65D 81/3261* (2013.01); *B65D 65/46* (2013.01)

(58) Field of Classification Search
None
See application file for complete search history.

(56) References Cited

U.S. PATENT DOCUMENTS 8,754,025 B2 6/2014 Wiedemann et al.
2001/0033883 A1 10/2001 Boody
(Continued)

FOREIGN PATENT DOCUMENTS

CN 101583707 11/2009
EA EP1394065 3/2004
(Continued)

OTHER PUBLICATIONS

Search Report in EP13172900 dated Dec. 9, 2013, pp. 1 to 3.
(Continued)

*Primary Examiner* — Lorna M Douyon
(74) *Attorney, Agent, or Firm* — Foley & Lardner LLP

(57) ABSTRACT

A multi-compartment water-soluble capsule thermoformed from two sheets of water-soluble film, the capsule comprising a least two compartments with a different part of a detergent composition in each compartment, the two sheets of film being sealed together to form seal areas around each compartment, all the seal areas lying substantially in a first plane; —the capsule having at least one larger volume outer compartment and at least one smaller volume inner compartment generally enclosed in the first plane by the outer compartment(s), the outer compartment(s) being separated from the inner compartment(s) by a continuous partition seal area which is substantially rectangular and lies in the first plane, —the outer compartment(s) having a generally rectangular outer perimeter with rounded corners and a substantially uniform cross-section taken along a plane perpendicular to the first plane and perpendicular to the inner seal separating the inner and outer compartments.

16 Claims, 4 Drawing Sheets

(51) Int. Cl.
*B65D 65/46* (2006.01)
*B65D 81/32* (2006.01)

(56) References Cited

U.S. PATENT DOCUMENTS

| | | | | |
|---|---|---|---|---|
| 2004/0118711 | A1* | 6/2004 | Duffield | B65D 65/46 206/219 |
| 2006/0243630 | A1* | 11/2006 | Bourgoin | C11D 17/042 D17/42 |
| 2007/0267316 | A1* | 11/2007 | Ayats | B65B 9/042 206/524.7 |
| 2011/0250241 | A1 | 10/2011 | Duffield | |

FOREIGN PATENT DOCUMENTS

| | | | |
|---|---|---|---|
| EP | 1375637 | | 1/2004 |
| EP | 2567898 | A1 * | 3/2013 |
| GB | 2374580 | | 7/2003 |
| WO | WO0208360 | | 1/2002 |
| WO | WO2009056861 | | 5/2009 |
| WO | WO20100088112 | | 8/2010 |

OTHER PUBLICATIONS

Search Report in PCTEP2014061858 dated Sep. 29, 2014, pp. 4 to 6.

Written Opinion in EP13172900 dated Dec. 9, 2013, pp. 7 to 7.

Written Opinion in PCTEP2014061858 dated Sep. 29, 2014, pp. 8 to 11.

Notice of Opposition in EP147285779 (EP3010821) Henkel, dated Oct. 19, 2017.

* cited by examiner

PRIOR ART

MULTI-COMPARTMENT WATER-SOLUBLE CAPSULES

TECHNICAL FIELD

This invention relates to multi-compartment water-soluble capsules comprising at least two compartments made from water-soluble film, each compartment containing a part of a detergent composition.

BACKGROUND

Multi-compartment water-soluble detergent capsules made with water-soluble film are known. The water soluble-film is typically polyvinyl alcohol. The preferred capsule manufacturing process involves thermoforming the film. By thermoforming is meant a process in which a first sheet of film is subjected to a moulding process to form recesses in the film. The process involves heating the film to soften it and also the application of vacuum to hold the film in the moulds. The recesses are then filled, typically with a detergent liquid. The capsules are completed by overlaying a second sheet over the filled recesses and sealing it to the first sheet of film around the edges of the recesses to form a flat seal area. Relaxation of the first film typically then causes the applied second sheet to bulge out when the vacuum is released from the first sheet of film in the mould. The capsules are cut apart to leave part of the flat seal area as a peripheral "skirt" around each capsule when it is removed from the mould. Although the seal is flat when in the mould it may deform a little when removed from the mould. Likewise a rectangular profile capsule usually relaxes slightly away from having a perfect rectangular profile after it is released from the mould. Throughout this specification flat seals are ones that are moulded flat and rectangular capsules are ones formed in rectangular moulds, usually with their corners rounded off. Multi-compartment capsules are suited for delivery of main wash laundry compositions to automatic washing machines and even for hand wash applications. Although a multi-compartment configuration is more difficult to manufacture than a single compartment it may be chosen because components of the detergent composition need to be mixed at point of use and/or have reduced stability when stored together. It may also give the capsule aesthetic appeal because the different compartments can be filled with different coloured contents. In general the formulator would like to keep the number of compartments to a minimum in order to avoid complexity and added cost.

Multi-compartment water-soluble detergent capsules comprising from 2 to 5 compartments obtained by thermoforming a water-soluble film are disclosed in EP 1375637 and EP 1394065 (Unilever). Each compartment of the package contains a different part of a cleaning composition and the compartments are connected to each other and separated from one another by at least one flat seal area. One compartment may contain a liquid part of the detergent composition and another compartment a granular part of the composition, such as bleach or builder. A problem with capsules having their compartments separated by a flat seal area that extends across the capsule as described in most of the embodiments disclosed is that they are floppy because they will fold up along the flat seal. This folding has been found to cause handling problems and a floppy capsule is not liked by consumers. FIG. 1 shows plan and side elevations of a foldable two-compartment water-soluble capsule as described in these documents. FIG. 2 shows the one embodiment (FIG. 1*d*) from EP 1375 637A1 that does not suffer from this undisclosed folding problem. A generally rectangular compartment surrounds a small circular compartment. From paragraph 0079 we are told that the larger compartment contained 50 ml of the liquid formulation and the small compartment 7 g of the semi-solid formulation. According the preceding paragraph 0078 the liquid composition comprised:

| Ingredient | Parts by weight |
|---|---|
| LAS, monoethanolamine salt | 24.0 |
| Nonionic 7EO | 20.3 |
| Soap | 22.4 |
| Monopropyleneglycol | 23.7 |
| Moisture, salts, NDOM | 6.9 |
| Minors (enzymes, polymers, perfume) | 2.7 |

From paragraph 0077 it is disclosed that the semi solid composition comprised:

| Ingredient | Parts by weight |
|---|---|
| Na-LAS | 39.1 |
| Nonionic 7EO | 33.5 |
| C12 soap | 7.3 |
| Monopropyleneglycol | to 100 |

In WO2010 0088112 a two compartment "stacked" capsule is made having a smaller liquid compartment and a larger powder compartment. The two compartments are separated only by a thin layer of polyvinylalcohol film. The disclosure is mainly focused on dishwashing compositions and the exemplary two compartment capsule has the following liquid and granular compositions in its compartments:

| Ingredient | % in compartment | % in capsule |
|---|---|---|
| Percarbonate bleach | 74.9 | 64.369 |
| Acrylic acid/maleic acid copolymer | 7.5 | 6.446 |
| Polyacrylate or polycarboxylate polymer | 13 | 11.172 |
| Proteases and amylase enzyme mix | 3 | 2.578 |
| HEDP granular | 1.5 | 1.289 |
| Perfume | 0.1 | 0.086 |
| Total in powder compartment | 100 | 85.94 |
| Dipropylene glycol | 57.29 | 5.970 |
| Glycerine | 2.99 | 0.312 |
| Colour | 0.9 | 0.094 |
| Surfactant LF244 | 29.47 | 3.071 |
| Nonionic surfactant | 2.63 | 0.274 |
| Water | 6.72 | 0.700 |
| Total in liquid compartment | 100.00 | 10.42 |

It was also known, from the product sold as "Tide Pods" or "Ariel Pods", to assemble two thermoformed "capsules" to form a multi-compartment capsule whereby a first "capsule" having at least two smaller liquid compartments joined together with foldable flat seals is then used to seal a larger compartment. This configuration prevents the seals from folding. However, this approach suffers from the disadvantages of a complex manufacturing process and having a seal area with triple layers of film. To avoid dissolution problems resulting from such triple layer seals it is necessary to use thinner than normal film, which leads to issues with leakage due to pin-holing of the thinner film elsewhere in the capsules during manufacture.

Polyvinylalcohol film cannot completely prevent migration of the contents of one liquid compartment into another. In any capsule where there is a liquid compartment separated from other ingredients only by a single thin layer of polyvinylalcohol film the ability to effectively segregate ingredients that need to be kept apart until use is inevitably compromised. For example in the three compartment capsule, only the contents of the two smaller liquid compartments can be considered to be effectively segregated, so it takes a minimum of three compartments to achieve significant segregation benefits when using this approach. The need to include sensitive ingredients in the smaller compartments then drives complexity as more and more of the smaller compartments are needed to keep these sensitive ingredients segregated from one another.

An alternative to thermoforming of capsules is a vertical form fill seal process (VFFS). US 2001/0033883 (Body) discloses multi-compartment capsules having separate compartments for granular and liquid materials, preferably popcorn kernels and oil, the contents being packed so that they can move within their respective compartments on the application of an external force thereby inhibiting the rupture of the compartments. A two compartment capsule has three layers of film. The extra third layer being used to form an internal partition between the fluid material in one compartment and the granular materials in a second compartment. If applied to a detergent composition this construction suffers from possible contamination of the granular compartment by transfer of liquid through the film. Such preformed packs are also more expensive to produce than thermoformed packs.

A known issue with water-soluble detergent capsules, including those used in automatic laundry washing machines, is that consumers do not read the instructions for their use carefully and therefore may use them incorrectly. They are known to put the capsule into the washing machine dispensing drawer when it should be added directly to the drum and they are also known to use capsules in overloaded water conserving washing machines where the capsule may then not be exposed to much water.

There is a need for an improved multi-compartment water-soluble thermoformed capsule design, particularly one that uses only two layers of water-soluble film and is capable of withstanding the expected abuses by consumers.

SUMMARY OF THE INVENTION

According to the present invention there is provided a multi-compartment water-soluble capsule thermoformed from two sheets of water-soluble film, the capsule comprising a least two compartments with a different part of a detergent composition in each compartment, the two sheets of film being sealed together to form seal areas around each compartment, all the seal areas lying substantially in a first plane;

the capsule having at least one larger volume outer compartment and at least one smaller volume inner compartment generally enclosed in the first plane by the outer compartment(s), the outer compartment(s) being separated from the inner compartment(s) by a continuous partition seal area which is substantially rectangular and lies in the first plane, the outer compartment(s) having a generally rectangular outer perimeter with rounded corners and a substantially uniform cross-section taken along a plane perpendicular to the first plane and perpendicular (radial) to the inner seal separating the inner and outer compartments.

If there is more than one inner compartment then each inner compartment is separated by a partition seal also lying in the first plane and formed from the two sheets of film. If there are also multiple outer compartments then the partition seals for those outer compartments are also in the first plane and there are two such outer partition seals for each additional outer compartment.

When present, preferably the outer partition seals do not align with any inner partition seals present. By arranging that the multiple inner and multiple outer compartment seals do not align this ensures that the capsule is not able to fold on itself.

Preferably there is only one inner compartment. More preferably it contains a powdered or granular part of the detergent composition, most preferably granular. By granular is meant particles generally larger than 200 micron in diameter, even larger than 350 micron diameter.

The compartments are thermoformed, a first lower film being heated and then held by vacuum in a mould while the inner and outer compartments are filled. Powdered or granular parts of the composition are preferably filled into their compartment(s) before any liquid parts of the composition are filled into their compartment(s). This has the advantage that any spilt solid material can be removed from the liquid compartment(s) and seal areas before the liquid is filled into them.

Preferably the (uniform) cross-section of the at least one outer compartment is substantially circular. This is achieved by use of a semi-circular mould cross-section for the compartment. The relaxation of the formed capsule once it has been removed from the mould makes the semi-circular cross-section change to be nearer to a fully circular cross-section. In any event the cross-section remains substantially uniform because the relaxation is substantially uniform. The uniform cross-section is preferably formed by having a uniform width the mould cavity, i.e. the distance between the inner and outer edges of the outer compartment is constant in plan view.

Preferably there is a single, generally rectangular in plan, inner compartment located about the centre of the capsule and there is also a single outer compartment extending circumferentially and continuously around the inner compartment and defining a continuous partition seal of generally uniform width and an outer compartment of generally uniform width extending outwardly away from the inner compartment. In that case the capsule has two compartments.

Preferably the multi-compartment capsule has the at least one outer compartment(s) filled with liquid parts of the detergent composition and the at least one inner compartment (s) filled with free flowing granular or powdered parts of the detergent composition, the contents of all the compartments when combined forming a full detergent composition which is released on dissolution or rupture of the water-soluble films encasing the compartments. Most preferably there is a single liquid part of the composition in a single outer compartment and a single granular part of the composition in a single rectangular inner compartment. By a single granular part is meant a substantially homogeneous mixture of granules and/or powder that may individually have different compositions. For example: a mixture of granules comprising enzyme and granules comprising sequestrant. The term granule includes agglomerated particles.

The film is preferably polyvinyl alcohol film and it is more preferably less than 100 micron thick in the finished capsule.

An advantage of this capsule shape is that during the thermoforming process the constant cross-section of the outer compartment means that the water-soluble film is drawn simultaneously into all parts of the mould cavity and to the same extent around the outer mould cavity to form the outer compartment. This means that it is drawn at an equal rate and this reduces problems of ridge formation and pin-holing which leads to damaged film, leakage and distortion of the outer compartment. Whilst, a single circular outer compartment would also solve the problem of uneven film draw, it would also provide inefficient use of the films due to the moulds typically being arranged in a rectangular pattern in thermoforming processes which will generate large and unnecessary outer seal areas.

Furthermore, since a circular outer compartment would make the projected shape of the inner compartment circular too and that would increase problems with the filling of the inner compartment, especially if granular materials were used. The symmetrical recess of a circular thermoformed inner compartment can cause granules to bounce out during high speed filling. Such a high speed is needed to have a commercially viable process. Making the inner compartment rectangular avoids this bouncing out problem and also provides for a longer travel time past the filling head compared to an equivalent volume circular inner compartment.

It will be appreciated that the projection of the generally rectangular outer compartment(s) always results in a rectangular central area to form the rectangular inner compartment(s) when the cross-section of the outer compartment is uniform and constant and the continuous seal between the inner and outer compartment s is as narrow as possible to avoid wastage of film.

The flat profile of the capsule, together with the cavity formed by the seal between the inner and outer compartments when there is a single continuous outer compartment has been found to give the capsule unexpected consumer related advantages. It has been found that it dispenses well from a washing machine drawer. Furthermore it has been found that it will deliver its contents well even if only a very small quantity of water falls onto it, when placed in the drum of the washing machine, on top of the load.

A yet further unexpected advantage of this capsule shape has been the way that it seems to automatically take up less volume in a pack due to the shape helping it to form stacks of capsules with minimal wasted space in between. It would even be possible to dispense the capsules from a tube like pack containing a highly efficiently packed single stack of capsules.

BRIEF DESCRIPTION OF THE DRAWINGS

The invention will now be further described with reference to the following non-limiting examples and with reference to the drawings, of which.

DETAILED DESCRIPTION OF THE INVENTION

Figure 1:
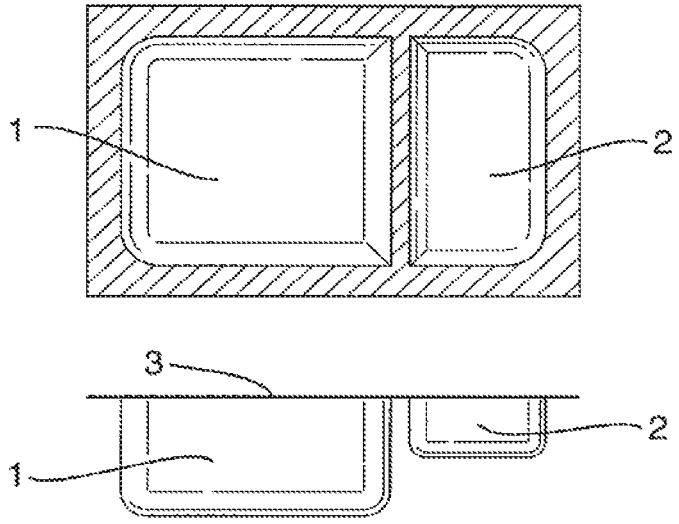
FIG. 1 is a plan and side view of a prior art two-compartment capsule.

Thermoforming Process.

The multi-compartment capsule is produced by a process of thermoforming. Such a process may advantageously comprise the following steps to form the preferred two compartment capsule:

(a) placing a first sheet of water-soluble polyvinyl alcohol film over a mould having sets of cavities, each set comprising an inner cavity surrounded by an outer cavity;

(b) heating and applying vacuum to the film to mould the film into the cavities and hold it in place to form two recesses in the film; an inner recess and an outer recess connected to the inner recess by the film;

(c) filling two different parts of a detergent composition into the inner and outer recesses, the parts together forming a full detergent composition;

(d) sealing a second sheet of film to the first sheet of film across the formed recesses to produce a two compartment capsule having an inner compartment and a surrounding outer compartment, wherein the two compartments are connected to each other and separated by a continuous flat seal area.

(e) cutting between the outer compartments so that a series of multi-compartment capsules are formed, each capsule containing a part of a detergent composition in two compartments (one inner and one outer compartment).

Sealing can be done by any suitable method for example heat-sealing, solvent sealing or UV sealing. Particularly preferred is water-sealing. Water sealing may be carried out by applying moisture to the second sheet of film before it is sealed to the first sheet of film to form the seal areas.

The seal area between the inner and outer compartments preferably has a width of from 1 to 10 mm, most preferably from 1.5 to 4 mm.

Typically the outer compartment(s) will have an area in the first plane of from 100 to 5000 $mm^2$, more preferred from 400 to 4000 $mm^2$, most preferred from 800 to 3500 $mm^2$ and the inner compartments will have an area in the first plane of from 50 to 1200 $mm^2$, more preferred from 100 to 800 $mm^2$, most preferred from 150 to 550 $mm^2$.

The shape of the outer compartment or compartments taken together in the first plane comprises curved and generally straight lines. The preferred shape for the outer compartment is generally rectangular. By generally rectangular is meant that the plan view of the shape has rounded corners. Furthermore, the sides of the rectangle may be slightly curved due to relaxation of the capsule on removal from the mould. For example the outer sides of the outer compartment may be slightly concave so the capsule is wider near to the corners than it is in the centres of the sides. Capsule shapes with the outer compartment based on a rectangle with rounded corners are preferred because the polyvinyl alcohol film seals around the outer compartment may then easily be slit or cut to separate capsules from one another. The substantially constant cross section of the outer compartment then projects this shape inwardly to make the inner compartment also generally rectangular.

Preferably each compartment has a maximum depth of from 5 to 40 mm, more preferred from 8 to 35 mm, most preferred from 9 to 15 mm. When the outer compartment contains liquid and the inner compartment contains granular solid material the depth of the outer compartment may be greater than the depth of the inner compartment. The result of such smaller depth inner compartment(s) is that the outer compartment(s) protect the inner compartment(s), not only by surrounding them in the first plane, but also by reducing the chance that the inner compartments come into contact with outer compartments of other capsules when the capsules are stored. This is a particular benefit when the inner compartments contain a dry powder and/or granular part of the detergent composition which needs to be kept as separated as possible from the liquid compartments. The ratio of the deepest compartment to the least deep compartment may be from 5:1 to 1:1, more preferred 3:1 to 1.1:1, most preferred from 2:1 to 1:1. The depth may be considered in this context to be either the maximum draw depth into the mould or the total depth perpendicular to the first plane after the first film and second films have relaxed to form the finished capsule: the two ratios are substantially the same.

In one embodiment the depths of the mould cavities for the inner and outer compartments are approximately the same. In another embodiment the inner compartment is deeper than the outer compartment; this can be advantageous especially when powders are to be filled into the inner compartment.

If desired the release time of the parts of the detergent composition in each compartment can be adjusted by altering aspects of the capsule shape and manufacturing process. For example, by changing the draw depth relative to the compartment width a compartment has the thickness of its film adjusted, which in turn affects the time for rupture and also dissolution in use.

The ratio of areas in the first plane of the outer compartment(s) to the inner compartment(s) may be from 20:1 to 1:1, more preferably from 10:1 to 1.2:1, most preferably from 8:1 to 2:1.

The compartments may be shaped in such manner that the average film-thickness of the inner and outer compartments differ. If this is the case it is preferred for the inner compartment(s) to be thinner than the outer compartment(s). Preferably at least four measuring points are taken per compartment to calculate the average.

Suitable methods to reduce the average film thickness of a compartment are known in the art.

Preferably the first film thickness (pre thermoforming) is from 50 to 150 micrometer, more preferably from 60 to 120 micrometer, most preferably from 80 to 100 micrometer. After capsule manufacture generally the average thickness of the first film will be from 30 to 90 micrometer, more preferably from 40 to 80 micrometer.

The second film is typically of a similar type to that used for the first film, but slightly thinner, preferably from 50 to 75 micron. In an advantageous embodiment of the invention the ratio of thickness of the first film to the thickness of the second film is from 1:1 to 2:1. Advantageously the initial thickness for the second film may be from 20 to 100 micrometer, more preferably from 25 to 80 micrometer, most preferably from 30 to 60 micrometer.

A preferred thermoforming process uses a rotary drum on which the forming cavities are mounted. A vacuum thermoforming machine that uses such a drum is available from Cloud LLC. The capsules according to the invention could also be made by thermoforming on a linear array of cavity sections. Machines suitable for that type of process are available from Höfliger. The following example description is focussed onto the rotary process. A skilled person will appreciate how this would be adapted without inventive effort to use a linear array process.

Detergent Composition

The detergent composition may be any type of cleaning composition for which it is desirable to provide a dose thereof in a water-soluble capsule. The multi-compartment capsules comprise at least two different parts of the detergent composition. Preferably one part of the detergent composition is particulate; and another is a liquid.

Suitable detergent compositions that may be split into different components for use in the present invention include those intended for laundry (fabric cleaning, softening and/or treatment) or machine dishwashing. Preferred are laundry compositions, particularly laundry cleaning compositions.

The multi-compartment capsules comprise in at least two compartments at least two different parts of a detergent composition which, when combined, make up the full detergent composition. By that is meant that the formulation of each of the parts of the detergent composition is different either in its physical form, its composition or its colour. Sometimes it will be sufficient to only have minor differences between the parts of the detergent composition e.g. colour, perfume etc. Often, however, it will be advantageous to have visible differences, for example a clearly different physical form of the detergent composition. In this context suitably one part of the composition in one compartment may, for example, be a solid (e.g. a particulate or powdered formulation) while another part of the composition in another compartment may be a liquid or a semi-solid. The smaller central compartment may comprise sequestrants, enzymes, bleach catalysts, perfume, builders etc, most preferably in granular form.

Advantageously the outer compartment(s) of the multi-compartment capsule will be filled with liquids. By filled it is meant that the compartment contains liquid and a gas bubble. The presence of the gas bubble provides some protection from compression of the compartment due to its compressibility. The gas is preferably air trapped in the compartment during manufacture. Also advantageously the inner compartments of the multi-compartment capsule will contain granular material. To maintain the granular material in a free flowing and easily dispersible state it is preferable that the inner compartments are not completely filled. I.e. they, like the liquid compartments, have a visible amount of air trapped inside them during manufacturing and subsequently retained in the finished capsule. We have found that such partially filled powder cavities provide a number of advantages including better dispersal of the contents on dissolution and a sensory result when the loose powder is shaken and makes an engaging noise audible to a consumer. The liquid compartment and the granular compartment are separated by the flat seal area as described above. Preferred liquids have a viscosity in the range 100 to 1000 cP.

A liquid part of the composition in a compartment preferably has a low water content of less than 10 wt %, more preferably from 0.5 to 9 wt % water, most preferably from 1 to 7 wt %.

A particulate part of the composition in a compartment preferably has some moisture in the granules to avoid the film drying out and becoming brittle. 1 to 5 wt % moisture is preferred. The particles may be prepared by granulation and may contain a mixture or ingredients. It is preferred that they do not contain any organic detergent surfactant as it may cause the granules to stick together such that they disperse poorly on dissolution of the capsule. Suitable granulation methods are well known in the art. The granulated particles may be optionally mixed with other materials to form the particulate composition. The granules may be partially dyed to make a speckled material, or fully dyed to render the compartment full of coloured material.

Preferably the particulate composition has a bulk density measured by a tap down method as known in the art of at least 400 g/liter, preferably at least 500 g/liter, and most preferably at least 600 g/liter.

Surfactants

The detergent composition may comprise one or more organic surfactants. Many suitable detergent-active compounds are available and are fully described in the literature, for example, in "Surface-Active Agents and Detergents", Volumes I and II, by Schwartz, Perry and Berch.

The organic surfactant may be anionic (soap or non-soap), cationic, zwitterionic, amphoteric, nonionic or mixture of two or more of these. The preferred organic surfactants are mixtures of soap, synthetic non-soap anionic and nonionic compounds optionally with amphoteric surfactant.

Anionic surfactant may be present in an amount from 0.5 to 50 wt %, preferably from 2 wt % or 4 wt % up to 30 wt % or 40 wt % of the detergent composition. Suitable examples include alkyl benzene sulphonates, particularly sodium linear alkyl benzene sulphonates having an alkyl chain length of $C_8$-$C_{15}$; olefin sulphonates; alkane sulphonates; dialkyl sulphosuccinates; and fatty acid ester sulphonates.

Suitable nonionic surfactant compounds include in particular the reaction products of compounds having a hydrophobic group and a reactive hydrogen atom, for example, aliphatic alcohols, acids, amides or alkyl phenols with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

In a fabric washing detergent composition, these organic surfactants preferably comprise 5 to 50 wt % of the detergent composition. In a machine dishwashing composition, organic surfactant is likely to constitute from 0.5 to 8 wt % of the detergent composition and preferably consists of nonionic surfactant, either alone or in a mixture with anionic surfactant.

Builders and Sequestrants

The detergent compositions may contain a so-called detergency builder which serves to remove or sequester calcium and/or magnesium ions in the water.

Soluble builder may be added to a liquid part of the composition. For example sodium citrate or a soluble sequestrant, for example, Dequest 2066, which may also assist with stabilising the liquid.

A water soluble builder may alternatively or additionally form part of the granular or solid part of the composition. A material beneficially provided as a solid is HEDP which is difficult to dissolve in the type of non aqueous liquid typically utilised in the liquid part of the composition.

The builder or sequestrant material is preferably fully soluble so as to eliminate the possibility of unwanted and unsightly residues on fabrics. For that reason Alkali metal aluminosilicates are not favoured.

Non-phosphorus water-soluble detergency builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates. Electrolytes such as sodium carbonate are not preferred due to the way they suppress the solubility of polyvinylalcohol.

Bleach System

The detergent compositions may contain a bleach system. This preferably consists of an air bleaching catalyst. For example the catalyst being a ligand of the formula (I) complexed with a transition metal, selected from Fe(II) and Fe(III), (I)

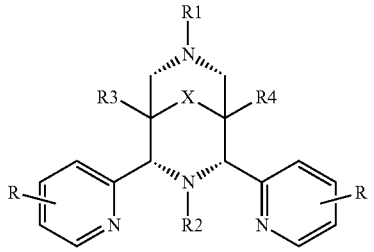

Where R1 and R2 are independently selected from:

C1-C4-alkyl,

C6-C10-aryl, and, a group containing a heteroatom capable of coordinating to a transition metal, wherein at least one of R1 and R2 is the group containing the heteroatom; preferably at least one of R1 or R2 is pyridin-2-ylmethyl. More preferably the catalyst is one in which R1 is pyridin-2-ylmethyl. Most preferably R1 is pyridin-2-ylmethyl and R2 is methyl;

R3 and R4 are independently selected from hydrogen, C1-C8 alkyl, C1-C8-alkylene-O-C1-C8-alkyl, C1-C8-alkylene-O-C6-C10-aryl, C6-C10-aryl, C1-C8-hydroxyalkyl, and —(CH2)nC(O)OR5;

wherein R5 is independently selected from: hydrogen, C1-C4-alkyl, n is from 0 to 4, and mixtures thereof; preferably R3═R4═—C(O)OMe and, each R is independently selected from: hydrogen, F, Cl, Br, hydroxyl, C1-C4-alkylO—, —NH—CO—H, —NH—CO—C1-C4-alkyl, —NH2, —NH-C1-C4-alkyl, and C1-C4-alkyl; preferably each R is hydrogen, X is selected from C═O, —[C(R6)2]y- wherein Y is from 0 to 3, preferably 1, each R6 is independently selected from hydrogen, hydroxyl, C1-C4-alkoxy and C1-C4-alkyl preferably X is C═O.

Most preferably the catalyst is ([Fe(N2py3o)Cl]Cl) with structure (II):

(II)

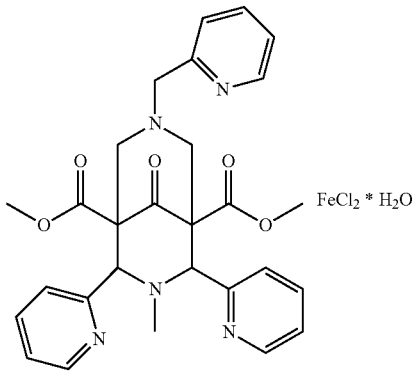

Also known as Iron(1+), chloro[rel-1,5-dimethyl (1R,2S, 4R,5S)-9,9-dihydroxy-3-methyl-2,4-di(2-pyridinyl-κN)-7-[(2-pyridinyl-κN)methyl]-3,7-diazabicyclo[3.3.1]nonane-1, 5-dicarboxylate-κN3, κN7]-, chloride (1:1), (OC-6-63)-[CAS Registry Number 478945-46-9].

To avoid possible gassing of ingredients it is preferred to avoid the use of persalt or peracid bleaching species in the capsules.

Further Optional Ingredients

Detergency enzymes may be employed in the compositions. If included in particulate form as granules, then they optionally have a protective coating.

The compositions may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenyl-styryl) disulphonate.

An antifoam material is advantageously included when organic surfactant is present; especially if the detergent composition is primarily intended for use in front-loading drum-type automatic washing machines. Soap is a suitable antifoam.

It may also be desirable that the composition comprises an amount of an alkali metal silicate. A detergent composition for machine dishwashing advantageously comprises at least 20 wt % silicate.

Further ingredients which can optionally be employed in laundry detergent compositions of the invention include antiredeposition agents such as sodium carboxymethylcellulose, straight-chain polyvinyl pyrrolidone and the cellulose ethers such as methyl cellulose and ethyl hydroxyethyl cellulose, fabric-softening agents; perfumes; and colorants or coloured speckles.

Capsule Material

The capsule is produced from a water-soluble film comprising polyvinyl alcohol or a polyvinyl alcohol derivative, i.e. a substantially uniform material. Such film materials can for example be produced by a process of blowing or casting.

The water-soluble film can also contain plasticizers, antifoams, anti-oxidants, surfactants, perfumes and the like.

Suitable films include Monosol M4045 and Monosol M8045 (75, 82, 88 & 90 micron) & Aicello PT films (PT 75 & 90).

The multi-compartment capsules are particularly suitable for use in (fabric) washing machines and in dishwashing machines amongst other applications. They can also be used in manual laundry and dishwashing operations. In use the capsules according to the invention are preferably, and conveniently, placed directly into the liquid which will form the wash liquor or into the area where this liquid will be introduced. The capsule dissolves on contact with the liquid, thereby releasing the detergent composition from the separate compartments and allowing them to form the desired wash liquor.

It is a particular advantage of the inventive capsules that they may alternatively be placed into a dispensing drawer of the type found in automatic laundry washing machines where water flows through the drawer. Surprisingly the capsules have been found to dispense effectively from such drawers.

A further unexpected advantage of the rectangular central compartment shape and the two compartment variant of the capsule is that the capsule is able to dissolve and disperse even if only minimal amounts of water fall onto it in the washing process. It seems that the volume of the recess combined with the thickness and type of the film is critical for this effect to be seen.

EXAMPLES

FIG. 1 shows a prior art type of multi-compartment thermoformed detergent capsule. The larger compartment 1 and the smaller compartment 2 may be partially filled with, for example, a liquid and a powder part of a detergent composition. After the second film 3 is sealed over the surface, the capsule is released from its mould and the second film will tend to bulge upwards as the first film relaxes. A known problem with this capsule is that it can fold along the flat seal area. This makes it difficult to handle by a consumer and also creates handling difficulties during manufacture and packing of the capsules.

Figure 2:
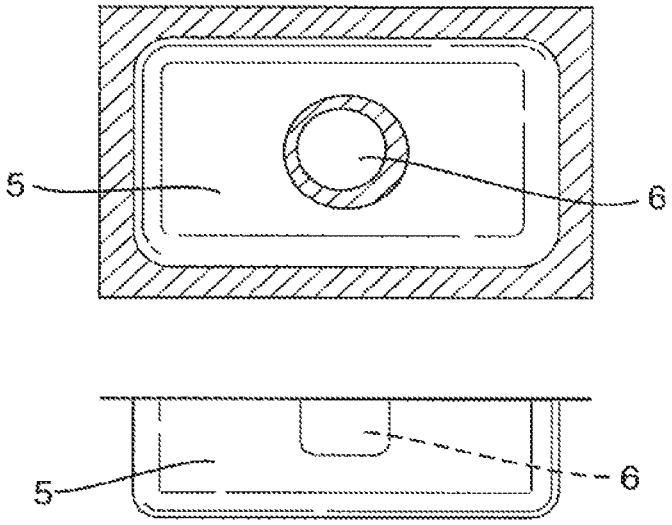
PRIOR ART Fig. 2
FIG. 2 is a plan and side view of a further prior art two-compartment capsule.

FIG. 2 shows a different type of prior art two-compartment soluble capsule. The large rectangular compartment 5 completely surrounds a much smaller circular plan compartment 6. The problems with this capsule are that the small compartment is not easily filled with granular material and that the variable cross section of the larger compartment imparts stresses to the capsule which cause it to distort after it is removed from the mould. Besides being unsightly, this distortion causes these capsules to fit less efficiently into a pack.

Figure 3:
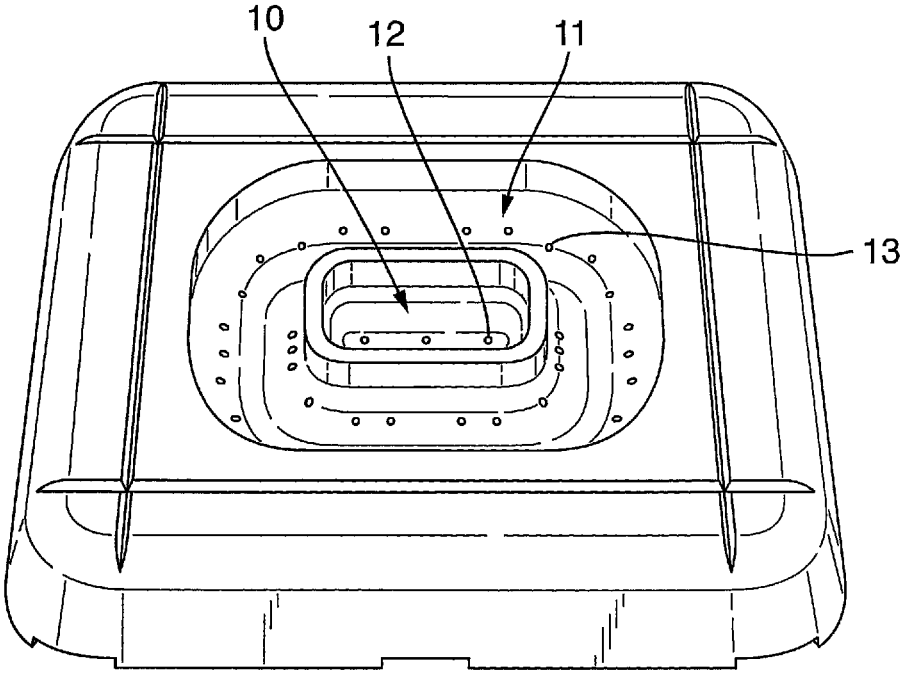
FIG. 3 is a pictorial view of a cavity section used for thermoforming the base film to obtain a two-compartment rectangular capsule according to the invention.

FIG. 3 shows a cavity section used to thermoform a first film to manufacture a capsule having an inner and an outer compartment. Each cavity section has an inner rectangular cavity 10 and an outer rectangular ring cavity 11. Each cavity is provided with a number of ducts 12, 13 to which may be applied a vacuum.

Figure 4:
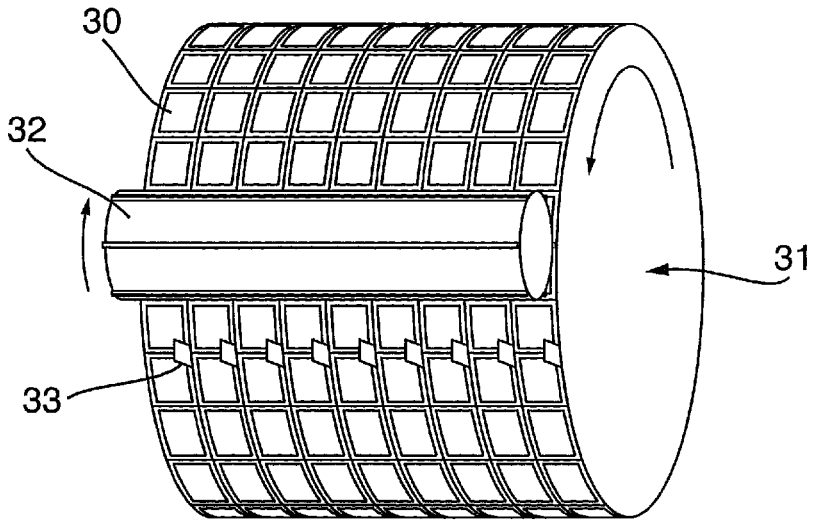
FIG. 4 is a view of the drum of a rotary thermoforming machine showing the cutting blades.

FIG. 4 shows a plurality of such cavity sections arranged in a rectangular array 30 on the outside of a rotary cylindrical drum with a horizontal axis 31.

Figure 5:
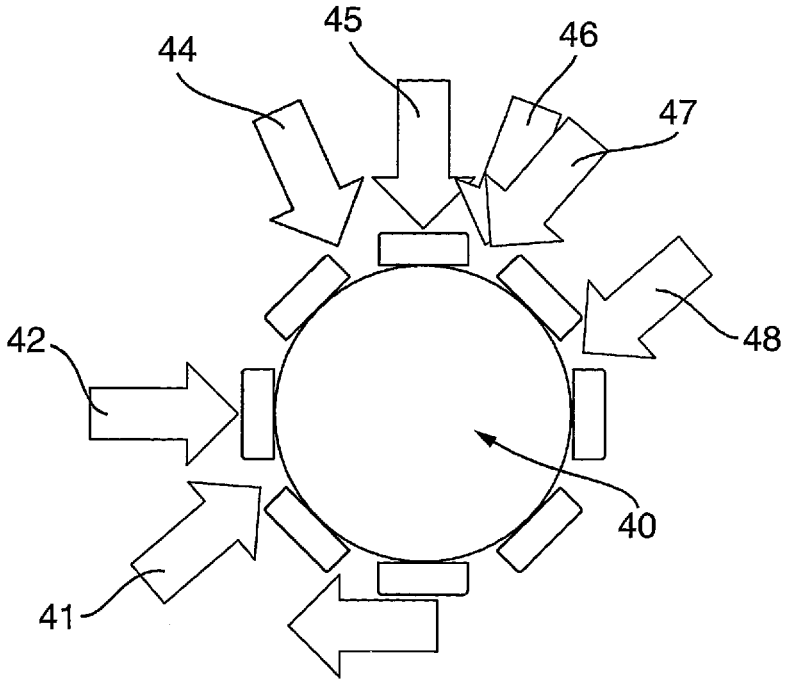
FIG. 5 is a side elevation of the drum area of a rotary thermoforming machine.

FIG. 5 shows the rotary cylindrical drum 40 from the side. The first film 41 is fed from a supply roll (not shown) over a heating roller (not shown) which has a nominal surface temperature of between 90 and 150° C. When the first film used is Aicello PT90 the heating roller temperature is maintained between 120 and 140° C.). Immediately after passing over the heating roller, the hot base film is fed onto the cavity section which is part of an array of such sections around a rotary drum. As shown in FIG. 4 the rectangular cavity sections are aligned with the longer of their sides in the direction of rotation of the drum.

Rotation of the cylinder so the cavities reach point 42 ensures that the heated first film fully covers the cavities in the cavity section. At point 42 a vacuum is then applied to the cavity section through its ducts. The vacuum is applied simultaneously to all the ducts. The vacuum pulls the first film into the cavities 10 and 11 (as shown in FIG. 3) and holds it there. A uniform thermoformed base film outer cavity shape is achieved due to the uniform cross-section of outer cavity 11.

We have found that it is important for the film to retain some elasticity at this stage. This leads to a tighter capsule which is preferred for ongoing line handling and robustness as well as consumer perception.

Once the cavities are thermoformed and held in place with the vacuum, the inner powder compartment 10 is filled first. This is conveniently done using a micro powder auger (not shown) located at a point 44, just before the cylinder reaches its higher position 45. For an inner compartment capacity of approx 5.5 ml the fill volume is aimed at approx 3.5 to 4 ml (64-73%). The augur delivers the powder to the cavity along the centre line and the advantage of a rectangular cavity is that the distance that the powder falls into the base of the cavity remains roughly constant for the entire fill time as the cavity 10 moves past the auger. Because the powder is filled on a slight incline and due to the way powder forms an inverted V shape in the cavity the maximum level of fill is less than 100%.

The outer liquid compartment 11 is filled second. This is done by a single filling pump with a split nozzle. The liquid is designed to fill down the two long sections of the cavity ring and that is why they are arranged to be aligned with the direction of rotation of the drum. Fill volume vs. brimful volume is aimed at a minimum of 80%. I.e. for a 28 ml liquid fill the cavity volume is thus at most 35 ml. Filling is done at the apex of the cylinder 45.

Immediately after filling of the liquid compartment the second film 46 is brought into position over the filled cavities. Immediately before this the second film has been passed through a water bath (not shown). This makes the lower surface of the second film 46 wet which acts as the mechanism for sealing the second film to the first film where it contacts it; thus forming the seal areas. The second film is a similar type to that used for the first film but is the slightly thinner 60 micron Aicello. The seal area is made secure by pressure application of a sealing roller at position 47.

Post sealing, the filled capsule is cut from the sheet at position 48. This is achieved by horizontal cuts from cylindrical cutter 32 and vertical cuts from static knife blades 33 as shown in FIG. 3.

Figure 6:
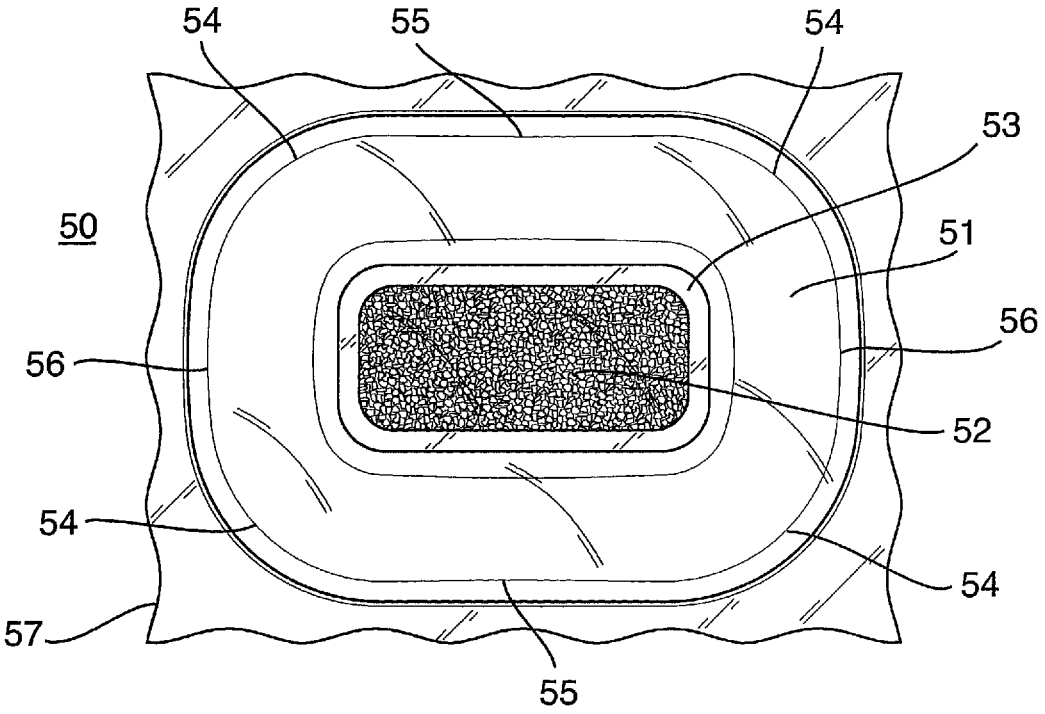
FIG. 6 is a plan view of a rectangular two-compartment capsule with inner granule containing compartment.
Figure 7:
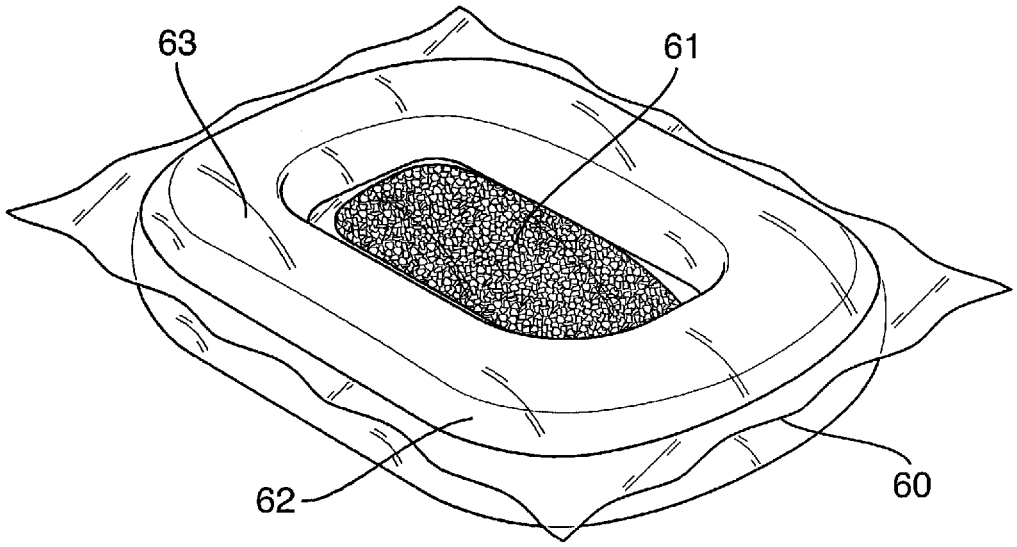
FIG. 7 is a three dimensional view of a rectangular two-compartment capsule with the compartment filled with granules.

FIG. 6 is a plan view of a finished capsule 50. The outer compartment 51 and inner compartment 52 are separated by the continuous flat seal area 53. The rounded corners of the outer compartment 54 and the longer sides 55 and shorter sides 56 of the outer compartment are projected to create the rectangular inner compartment 52. The cut seals around the outer compartment 57 are rectangular but are shown to have some distortion where the material has become corrugated. This is more clearly visible as 60 in FIG. 7. Also in FIG. 7 the way that the inner granule filled compartment 61 does not protrude above the outer liquid filled compartment 62 and the air bubble in the liquid compartment 63 is visible.

The advantage of a rectangular capsule over a square or other shaped capsule is twofold. First the choice of a rectangle leads to advantages filling the central compartment, especially if it is of comparatively low volume (say 20% of the size of the outer compartment) and most especially of it is filled with a powder component. Second the total seal area can be reduced. There is less waste film due to the selection of a shape with rectangular or square plan—compared say to a circular plan view—because the film must be cut in a square or rectangular shape. This either leaving large areas of outer seal or else requiring a separate and costly trimming operation, and resulting waste or recycle of the trimmings. Also, due to the fact that the cutting accuracy is greater for the seals running in the direction of movement of the capsule during manufacture a rectangular shape reduces the area of seals on each capsule and may at the same time increase film utilisation

EXPERIMENTS TO SHOW THE ADVANTAGES OF THE CAPSULES

Example 1—Dissolution Tests

In dissolution tests, the liquid compartment of the capsule ruptures quicker than a conventional single compartment thermoformed capsule containing a laundry liquid, thus releasing the liquid contents more quickly.

Example 2—Drawer Dispensing

A capsule as shown in FIG. 6 made from polyvinyl alcohol films and with a liquid filled outer compartment according to the invention was put into the drawer of a Zanussi machine on a 40° C. cotton program. This program allows water through the drawer at ambient temp. After the first inlet (30+ seconds) the capsule was still complete with no signs of dissolving. After the second water inlet (40+ seconds) the capsule was completely gone with no film, liquid or powder residues left. It was further observed that the load in the machine was producing a good foam, confirming that the capsule had gone into the drum and started dissolving.

The same procedure was done using a commercially available single compartment Ariel liquitab capsule. The whole capsule was still in the drawer after the first and second inlet of water and was still there 30 mins later. Although it had started to deform none of the liquid had come out of the film.

Example 3—Capsule Water Ingress

This study looked at benefit of the capsule design according to the invention compared to prior art capsules, in terms of rate of water ingress and liquid release when wet from above.

The capsule according to the invention was compared with commercially available Rectangular (Persil from Unilever), Square (Ariel from P&G), Multi-compartment Stacked Tide Pods 3 in 1 from P&G and Side-by-side two compartment capsules Persil Duo from Henkel.

First it was determined that 8 g of water could be held in the "well" between the inner and outer compartments of a capsule according to the invention. Then to observe the effect of exposure to this amount of water sprinkled from above onto each capsule the capsule to be tested was placed on top of an upturned beaker, allowing excess water to flow away as if the capsule was on top of a load of washing. Water was then poured over the capsule, and observations made.

In order to ensure this was a stress test 16 g of water was also used when testing the prior art commercially available capsule designs. The same sample placement and method of assessment was used throughout, with capsules arranged to maximise water retention.

| Capsule according to the Invention (8 g) results | |
|---|---|
| Water ingress (8 g): | Almost immediate |
| Liquid flow: | 15 seconds |
| Persil Duo (16 g) results | |
| Water ingress (16 g): | 25 seconds |
| Liquid flow: | Minimal after 1 minute |
| Persil Duo (8 g) results | |
| Water ingress (16 g): | None |
| Liquid flow: | None at 1 minute |
| Observation after 2 mins: | No water ingress or liquid flow |
| Persil (rectangle) (16 g) results | |
| Water ingress (16 g): | None |
| Liquid flow: | None at 1 minute |
| Observation after 2 mins: | No water ingress or liquid flow |
| Ariel Excel Tabs (square) (16 g) results | |
| Water ingress (16 g): | None |
| Liquid flow: | None at 1 minute |
| Observation after 2 mins: | No water ingress or liquid flow |
| Tide Pods (16 g) results | |
| Water ingress (16 g): | None |
| Liquid flow: | None at 1 minute |
| Observation after 2 mins: | No water ingress or liquid flow |

Observation Summary 8 g is enough water to induce considerable ingress and product flow after just 25 seconds with the rectangular well two-compartment capsule design.

Commercial liquid two-compartment Persil Duo capsules (from Henkel) are similar to the prior art two-compartment capsules of FIG. 1, they showed only minimal water ingress and liquid flow after 60 seconds. Using an 8 g water dose with Persil Duo produces no water ingress and liquid flow, even after 2 minutes.

From this test it can be seen that only the capsule design according to the present invention, with a well created by the inner and outer compartments and the continuous seal that joins them together, captures enough water and has a large enough surface area of film exposed to that captured water to give the required level of dispensing under sparse water conditions. The generally rectangular shape of the compartments increases the volume of the well and the surface area of the film exposed to the captured water. The well of the capsule design can therefore increase the speed of product dispersion. The prior art commercially available capsule designs provided less water ingress and liquid flow, even with double water delivery and double time of exposure.

The invention claimed is:

1. A multi-compartment water-soluble capsule thermoformed from only two sheets of water-soluble film, the capsule comprising:

a first compartment filled with a first detergent composition;

a second compartment filled with a second detergent composition different from the first detergent composition;

a first seal area disposed around the first compartment and along a first plane that divides the first compartment and the second compartment;

a second seal area disposed around the second compartment and along the first plane;

wherein the first compartment has a larger volume than the second compartment;

wherein the second compartment is enclosed in the first plane by the first compartment;

wherein the second compartment is shallower than the first compartment;

wherein the first compartment is separated from the second compartment by the second seal area which is substantially rectangular and lies in the first plane; and wherein the first compartment has a generally rectangular outer perimeter with rounded corners and a substantially uniform cross-section taken along a plane perpendicular to the first plane.

2. The capsule of claim 1, where if there is more than one second compartment then each second compartment is separated by a partition seal also lying in the first plane and formed from the two sheets of film.

3. The capsule of claim 1, wherein if there are multiple first compartments then the seal areas for those first compartments are also in the first plane.

4. The capsule of claim 1, in which there is only one second compartment.

5. The capsule of claim 1, wherein the second detergent composition comprises particulate detergent.

6. The capsule of claim 1, in which the substantially uniform cross-section of the first compartment(s) is substantially circular.

7. The capsule of claim 1, in which the first compartment(s) have a constant distance between their inner and outer boundaries in plan view.

8. The capsule of claim 1, wherein the second compartment is rectangular and located at the centre of the capsule and a single first compartment extending circumferentially and continuously around the second compartment and defining a uniform width separating seal and a uniform width of the first compartment extending from the second compartment.

9. The capsule of claim 1, wherein the first detergent composition comprises liquid detergent; and wherein the second detergent composition comprises free-flowing particulate detergent.

10. The capsule of claim 1, wherein the first detergent composition comprises a homogenous liquid detergent;

wherein the second detergent composition comprises a homogenous particulate detergent; and wherein the second compartment is rectangular.

11. The capsule of claim 1, comprising at least one third compartment partially filled with free flowing particles and the movement of the particles against the film of the third compartment makes an audible noise when the capsule is shaken.

12. The capsule of claim 1, in which the water-soluble film is polyvinyl alcohol.

13. The capsule of claim 1, in which the water-soluble film has a thickness of from 50 to 100 micron.

14. A laundry washing process comprising dispensing a capsule according to claim 1 from a washing machine drawer.

15. A laundry washing process comprising placing a capsule according to claim 1 inside a washing machine.

16. A process according to claim 15 in which the washing machine has a spray system.

* * * * *